United States Patent [19]

Avcin

[11] 4,044,685

[45] Aug. 30, 1977

[54] JACKETLESS HUNTING BULLET WITH ROLL-BACK CUTTING FLAGS

[75] Inventor: France Avcin, Ljubljana, Yugoslavia

[73] Assignee: Hirtenberger Patronen-, Zundhutchen- und Metallwarenfabrik Aktiengesellschaft, Hirtenberg, Austria

[21] Appl. No.: 662,166

[22] Filed: Feb. 27, 1976

Related U.S. Application Data

[63] Continuation-in-part of Ser. No. 442,432, Feb. 14, 1974, abandoned, which is a continuation of Ser. No. 264,278, June 19, 1972, abandoned.

[30] Foreign Application Priority Data

June 18, 1971 Austria ..... 5291/71

[51] Int. Cl.[2] ..... F42B 11/10

[52] U.S. Cl. ..... 102/91; 102/92.4

[58] Field of Search ..... 102/91, 92.1–92.6

[56] References Cited

U.S. PATENT DOCUMENTS

| | | | |
|---|---|---|---|
| 1,135,357 | 4/1915 | Clyne | 102/91 |
| 1,447,478 | 3/1923 | Koshollek et al. | 102/91 |
| 1,833,645 | 11/1931 | Hartz | 102/91 |
| 2,327,950 | 8/1943 | Whipple | 102/91 |
| 2,765,738 | 10/1956 | Frech, Jr. | 102/91 |
| 2,838,000 | 6/1958 | Schreiber | 102/91 |
| 3,003,420 | 10/1961 | Nosler | 102/91 |
| 3,348,486 | 10/1967 | Rapp | 102/92.3 |

*Primary Examiner*—Harold Tudor

*Attorney, Agent, or Firm*—Montague & Ross

[57] ABSTRACT

A jacketless hunting projectile or bullet of the mushrooming-tip, high cutting-type has a projectile body including a solid cylindrical guide part and a hollow head tapering toward a point. The hollow head has a progressively increasing wall thickness toward the solid part of the bullet and defines a cylindrical hollow space which receives a filling of a spreading material forming the tip of the projectile. This material rolls back the head after splitting it along notches formed in the hollow wall with sharp edges.

2 Claims, 5 Drawing Figures

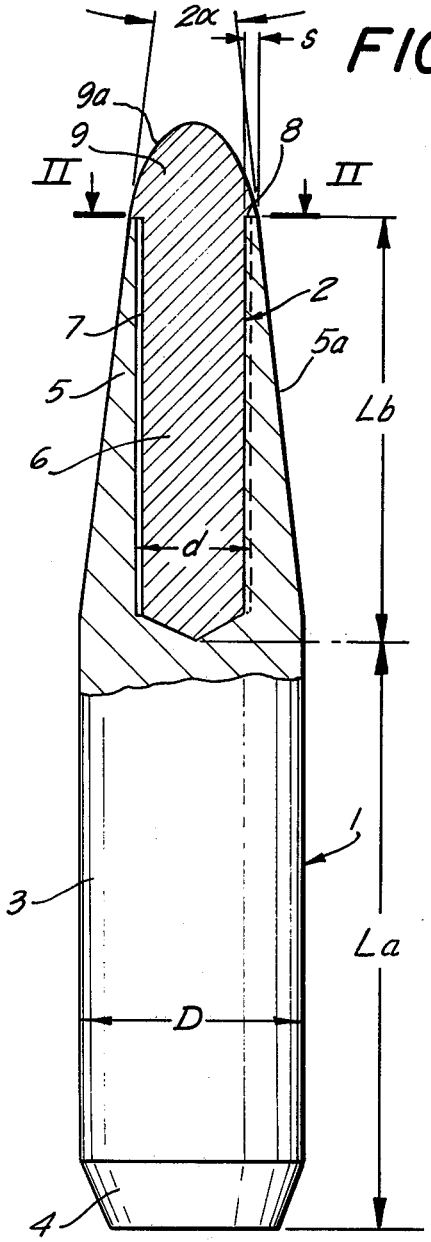
FIG. 1
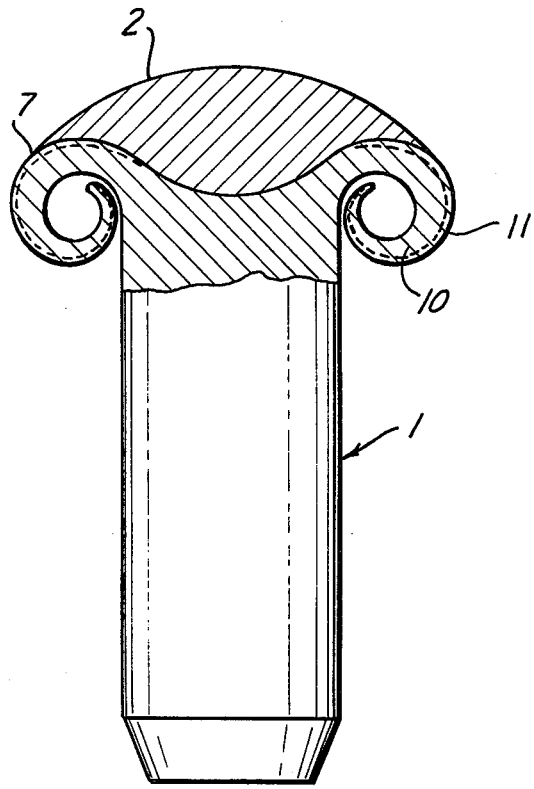
FIG. 4
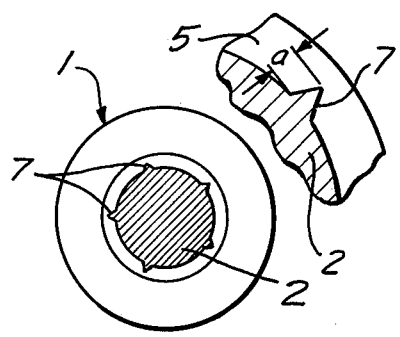
FIG. 3
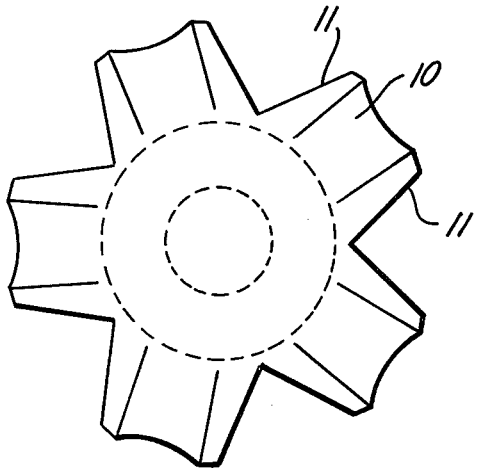
FIG. 2
FIG. 5

JACKETLESS HUNTING BULLET WITH ROLL-BACK CUTTING FLAGS

CROSS-REFERENCE TO RELATED APPLICATIONS

This application is a continuation-in-part of Ser. No. 442,432 filed Feb. 14, 1974 (entitled "HUNTING BULLET") now abandoned. That application was a continuation of Ser. No. 264,278 filed June 19, 1972 (now abandoned).

FIELD OF THE INVENTION

My present invention relates to a hunting bullet of the so-called jacketless type and, more particularly, to a hunting bullet which has only two parts and yet is more effective for the rapid halting of game than prior projectiles.

BACKGROUND OF THE INVENTION

It has long been known that an effective hunting bullet must fulfill a number of conditions.

a. The bullet should be capable of bringing about a fast kill, i.e. produce so much destruction upon the entry of the bullet with near normal strikes in the vicinity of the chest, that the game will not be able to hear or respond to the detonation of the firing. This ensures that the wounded animal will not engage in unnecessary activity or flee, creating problems with subsequent reclamation.

b. The shot should produce a relatively clean entry wound and a sufficiently large but clean exit wound with a significant dispersal of hair, reaching bone parts or blood so that, if the animal escapes, its path may be readily followed.

c. The projectile should maintain a constancy of direction in the body of the animal from the entry point to the exit point so that internal deviation does not occur, even upon traversal of strong bone parts. This minimizes the damage to the game.

d. The projectile should be suitable both for use with large animals and with small animals and thus should be capable of destroying game when used with too small an animal or being capable of killing when used with a larger animal. In other words, the bullets should be versatile with respect to the game against which it is used.

e. The bullet should also have good flight characteristics, i.e. a maximum impact speed for a given initial velocity and range, high accuracy at the usual ranges and good precision (i.e. closeness of targeting with a good weapon).

f. The bullet should, finally, be insensitive to deviations in the flight path produced by normal obstacles and therefor should have a flight path which is substantially unaffected by leaves, grass, reeds, branches and the like.

These requisites are associated with certain mechanical requirements.

This projectile should have a high degree of rotational symmetry, uniformity of mass distribution and good flow dynamics and should have a favorable position of the center of gravity with respect to the point of attack of a projectile upon the body of the animal and against the air.

It should also be capable of being manufactured without special machinery on all conventional machines, should be capable of withstanding the firing gas pressures, barrel friction and air friction, should be free from any tendency to deposit metallic residues in the barrel and should have structural integrity for firing and impact.

I have also been able, after considerable investigation, to determine several parameters which are vital for hunting projectiles if the latter are to be truly efficient for large game.

Firstly, the shock effect is proportional to the product of the tissue resistance R and the projectile speed $v$ in the tissue. P, representing the output of the projectile, can thus be defined by the relation:

$$P = R \cdot v.$$

However, since R is a function of the projectile head surface which is, in turn, a function of the product, $\pi \cdot D^2$ where $D$ is the diameter of the projectile head. $P$ can be defined as:

$$P = k \cdot D^2 \cdot v,$$

where $k$ is a constant.

Since $v$ is the entry velocity and is relatively large, $D$ must be small. It has been shown that good results are obtained only if the projectile lags in the animal and mushrooms outwardly relatively slowly.

At the exterior stage of the bullet-penetrating operation, the speed $v$ is assumed to have been reduced appreciably so that $D$ can increase more quickly and the head of the projectile thereby widens more rapidly. Thus, a maximum shock effect and a maximum tearing effect can be obtained.

Reference may also be made to the nerve shock generated around the passage made by the bullet in the animal. The nerve shock is a function of the kinetic energy which is proportional to the mass of the bullet and to the resistance of the body of the animal thereto. If this resistance is not sufficiently great, the bullet leaves the game in a more or less undamaged state and the wounded animal can thereby escape.

It is also important, with hunting bullets to ensure that the exterior wound is of such a nature that it does not close rapidly. For example, if one does not choose to seek escaped wounded game with a bloodhound, it is necessary to follow the trail produced by fluid discharged from the wound. Such discharge will only occur effectively if the exterior wound is substantially larger than the entry wound, this being usually only the same size as the caliber of the bullet. The exterior wound must be several times larger to prevent the skin from blocking the escape of fluids from the exterior wounds.

There is known for so-called humane killings of humans, the use of jacketed pointed military projectiles whose shapes must conform to the Geneva Treaty and are intended to penetrate the body cleanly and leave a small entry and exit wound.

It should be understood, therefore, that systems which utilize jacketed projectiles do not solve the problem dealt with in the present application.

There are, moreover, other situations which require a brief review. Firstly, the projectile must be such that it is capable of penetrating the skin of the animal and carry out this penetration with sufficient energy to allow mushrooming within the animal rather than prior thereto. Premature mushrooming is not desired and indeed it is essential that the projectile be capable of cleanly cutting through the skin at entry. In other words, the projectile must act like a cutter capable of penetrating the skin under the high rotary speed imparted to the projectile by the rifling of the gun barrel.

Secondly, it is desirable that the center of gravity of the projectile shift forwardly rapidly as the projectile passes through the tissues. This forward movement of the center of gravity with respect to, for example, the rear end of the projectile, should take place without eliminating the guiding effect of the cylindrical portion of the bullet. The mushrooming action should not cause the bullet to fall apart and it is desirable that the bullet change in shape or deform without splintering.

Of course, the outer surface of the bullet should be smooth and all edges should be eliminated to minimize the formation of MACH waves or compression waves which dissipate projectile energy to the air.

In view of the foregoing requisites, certain efforts have been made to overcome the disadvantages of the jacketed systems and improve the hunting qualities of a projectile. For example, a so-called "massive projectile", known from the French, has a solid cylindrical guide portion and means for providing a bursting charge at its head, e.g. for whale hunting. However, such projectiles are outlawed for war and are objectionable also as hunting projectiles.

More common, however, is a jacketed bullet in which a lead projectile core is surrounded by a copper or other sheet-metal jacket. The jacket is mushroomed outwardly in flight and occasionally falls apart leaving splinters. The jacket may be of brittle steel which also has a tendency to fall apart and hence the projectile forms a so-called "hail" shot. This has been deemed to be advantageous in hunting since the splinters were believed to increase the shot and damage within the animal.

In practice, however, the increased damage brought about by the formation of splinters is localized at the entry wound and usually the total damage consists of excessive skin damage without significant penetration and therefore with a minimum hunting effect.

It is believed that this disadvantage is a result of the fact that the lead flows over the deformed casing and imparts to the projectile a more or less ball-shape which does not penetrate to any significant effect and which does not cause any material damage after impact.

It has been proposed, therefore, to provide reinforcements on the casing to control the deformation thereof so that the balling up of the lead does not reduce the cutting effect and shock damage of the projectile. However, this has also proved to be unsatisfactory.

In another embodiment of the prior art, jackets of tough tearable material are provided to form long flaps and enable the main body of material in the bullet to mushroom cleanly and to produce a large diameter mushroom-shaped head.

This projectile has been found to be more effective than the first-mentioned one but also has the disadvantage that the opening and mushrooming of the flaps causes the projectile to deform unsymmetrically especially upon penetration of large game.

Another disadvantage is that the bullet may affect small game less and large game more than is required, with significant loss of the meat and damage to the internal structure of the animal.

OBJECTS OF THE INVENTION THE INVENTION

It is the principal object of the present invention to provide an improved bullet or projectile for hunting.

Another object of the invention is to provide a hunting bullet with high versatility and capable of obviating the disadvantages enumerated above.

It is also an object of the invention to provide a system which extends the principles set forth in the above-mentioned copending application.

It is also an object of the present invention to provide a hunting projectile or bullet which obviates the aforementioned disadvantages and fulfills the desiderata set forth above for an ideal projectile.

Another object of this invention is to provide a hunting projectile or bullet which can be used for a variety of game, which has good range and precision, which produces relatively clean entry and exit wounds while nevertheless insuring a sufficiently large exit wound to permit tracking of a wounded animal, and which provides a maximum of destruction along its path from the entry to the exit wound without undue tearing of tissue etc.

SUMMARY OF THE INVENTION

These objects are attained, in accordance with the present invention, in a hunting projectile or bullet of the jacketless type comprising a one-piece projectile body having a solid cylindrical portion extending substantially about half the length of the bullet and a frustoconical head converging away from the solid cylindrical portion. The head is formed with a generally cylindrical chamber defined by an internal wall formed with angularly equispaced axial grooves of sharp V cross section, the grooves extending over the full length of the cylindrical chamber and the head with the wide part of the V being open toward the axis of the body. The wall thickness of the frustoconical head at the mouth of the chamber is at most one third and is preferably one fifth or less than the radial thickness of the head at the large diameter end thereof. A mass of plastically deformable material fills the chamber and projects therefrom at the end of the head to form a tip for the bullet which is flush with the external wall of the head, the mass reaching to the cylindrical portion. The bullet consists at least 85% by weight of the projectile body and a maximum of 15% by weight of this deformable mass.

Advantageously, the cylindrical chamber has a diameter which is between one fourth and two thirds the diameter of the cylindrical portion of the projectile body, preferably about one half the diameter, and is of a length which is approximately four to five times its diameter. The overall length of the projectile should be approximately four to six times the diameter of the cylindrical portion and preferably is about five times this diameter.

The grooves can have a depth which is about one half the wall thickness of the frustoconical head at its small end thereof and between three and six (preferably four or five) such grooves may be provided. It has been found that the grooves cause the splitting of the head during passage of the projectile through the body of the game so that flags of the projectile curl back from the tip gradually and uniformly to provide sharp cutting edges which operate, because of the spinning of the projectile, to cut a relatively clean path through the body of the animal and at the same time maximizes the transfer of impact energy thereto. The impact of the projectile of the present invention upon the body of the game is preceded by the shock wave leading the projectile before its nose or tip comes into direct engagement with the hide or skin of the animal. This provides an initial shock which is increased as the tip of the projectile contacts the skin or hide. The initial contact begins a spreading action which tears the weakened thin-wall small end of the frustoconical portions of the projectile body along the grooves, thereby providing spreading flags which, with rapid rotation of the projectile, causes the latter to cut its way into the body of the animal.

Since the projectile body thickens progressively along these grooves, the spreading of the resulting flaps or "flags" and their curling back is retarded and more or less progressive, so that the speed of the projectile through the body is reduced. Rotation of the body about its axis continues the cutting action and the reduction is speed increases the energy transfer. The reduction in speed is accomplished by an increase in diameter whereby the energy released remains approximately constant along the path of the projectile through the animal body.

Toward the ends of its penetration path, the flags of the projectile are fully curled and have a ram's horn-like configuration whereby the thin wall portions tend to bear upon the shank of the plastic portion so that these flags are supported during the final exit-wound cutting and tearing action. As a consequence, cellular, fresher parts of the body are torn away through the exit wound and, while the latter is not made unduly large, a sufficient opening is provided to insure drainage through this wound of a magnitude sufficient to enable tracking of the game.

The projectile of the present invention has been made up in different calibers (e.g. 6.5 × 5.7R, 7 × 64, 7 × 65fr, 30–06, 8 × 51IS) and have been found to be effective on light, medium and heavy European red deer and black deer over distances of 300 to 450 meters and projectile weights of 9 to 10 grams. The heavier projectiles are found to be suitable for bear.

The projectile travels with accuracy, tends to fall over a given distance less than that which would be expected from the ballistics table and can be made inexpensively and on conventional equipment. It provides an effective gas seal because of the length of its cylindrical portion.

The plastically deformable mass can be any coherent material such as synthetic-resin or metal and can be, for example, lead.

BRIEF DESCRIPTION OF THE DRAWING

The above and other objects, features and advantages of the present invention will become more readily apparent from the following description, reference being made to the accompanying drawing, in which:

FIG. 1 is an elevational view partly in axial section, of a hunting projectile or bullet embodying the invention;

FIG. 2 is a section taken along the line II—II of FIG. 1;

FIG. 3 is a detail view, drawn to an enlarged scale, of a portion of the section of FIG. 2;

FIG. 4 is a view similar to FIG. 1 showing the projectile after it has been deformed by the impact; and FIG. 5 is a top plan view of the projectile in its deformed state.

SPECIFIC DESCRIPTION

The projectile shown in the drawing comprises a body 1 of a relatively tough but soft material such as tombac or a copper or copper alloy and has a cylindrical body portion 3 forming a guide part for the projectile in the rifle barrel, a short frustoconical part which facilitates insertion of the projectile into the rifle cartridge and a long frustoconical head 5. The projectile head 5 has a length $L_b$ which is slightly less than half the total length of the projectile and may be equal approximately to the length of the cylindrical part 3 although, most advantageously, its length is about 10% less than that of the cylindrical part, most desirably the ratio between the length of the conical head 5 (represented at $L_b$) and the remainder of the body of the projectile (represented at $L_a$) is $L_b/L_a=0.7=0.2$.

In the projectile head 5 a cylindrical hollow space 6 is formed, this hollow space having a length $L_b$ equal to that of its conical head and hence extending up to the guide part 3 of the projectile body so that the wall thickness of the projectile head increases continuously from the end thereof to its junction with the projectile body.

The diameter of the projectile body is represented at D while the internal diameter of the cylindrical space 6 is shown at *d*. Advantageously, the ratio *d:D* is about 0.50±0.5. Other important relationships are the relationship between the diameter *b* and the length $L_b$ of the cylindrical bore or hollow space 6 and thus $d:L_b=1:3$ to 1:4 in the preferred case. Similarly, the overall length $L_a \times L_b$ of the projectile body should have a ratio to the diameter D of $(L_a+L_b)/D=4.0\pm1.0$.

The hollow space 6 receives a plastically deformable mass 2 which projects from the projectile body and forms a tip 9 which can be rounded as shown. A rounded configuration is preferred to a pointed configuration of the tip. The outer surface 9a of this tip merges with the outer wall 5a and is flush therewith at the end face 8 of the projectile body 5.

In the inner of the projectile body control notches 7 are formed in angularly equispaced relationship parallel to the axis and of constant cross section over the full length of the hollow space 6. The notches 7 have equal-length flanks and have an altitude or depth *a* (FIG. 3) which is approximately equal to half the width *s* of the free edge 8 of the projectile body. Four or five such notches are preferred, the smaller number being used in the case of smaller caliber projectiles and the larger number for larger caliber projectiles. The cone angle of $2\alpha$ can conform to the conventional angle for large rockets.

With penetration, the projectile head assumes the configuration of the crown cutter (FIGS. 4 and 5) with the parts between the notches rolling into regular flags 10 which have sharp edges formed by the notches and are rotated at a sufficient speed by the firing and rifling of the weapon to cut through the animal.

The cylindrical filling 20 FIG. 1 is deformed into a spherical cup configuration as shown in FIG. 4. If the filling is composed of lead it can amount to about 15% of the total mass of the projectile with the remaining portions of the projectile body making up 85% of the weight. Where the filling mass is of plastic, almost all of the mass of the projectile is contributed by the projectile body. It is possible to avoid any splintering effect with this configuration and hence to maintain 100% of the projectile mass on its passage through the animal.

Note that the flags 10 have a ram's horn-like configuration (FIG. 4) which supports the free ends of the flags against further inward deformation when the cutting edges 11 are effected.

I claim:

1. A jacketless hunting bullet comprising:

a one-piece projectile body having a solid cylindrical portion extending over at least half the length of the bullet and a frustoconical head converging away from said solid cylindrical portion, said head being formed with a generally cylindrical chamber extending over the entire length of only said frustoconical head, terminating at said cylindrical portion and defined by an internal wall, said chamber opening at the small-diameter end of the frustoconical head and being surrounded at the latter end by a thin wall portion of said head, said wall being formed with a plurality of angularly equispaced axially extending grooves of constant V cross section with the wide part of the V being open toward the axis of said body, said grooves extending the full length of said generally cylindrical chamber, said grooves having depths of substantially half the wall thickness of said wall portion; and a mass of plastically deformable material filling said chamber and projecting therefrom at said end of said head to form a tip for the bullet, said tip having an outer surface flush with the external surface of said head at said portion, said mass reaching substantially to the solid cylindrical portion, said head having a length $L_b$, said body having a total length $(L_a+L_b)$, said solid cylindrical portion having a diameter D, said chamber having a diameter $d$ and the parameters $L_a$ $L_b$, D and $d$ being related so that the ratio $d:D$ is about $0.50\pm0.15$; the ratio $d:L_b=1:3$ to 1:4; and the ratio $(L_a+L_b)/D=4.0\pm1.0$.

2. The bullet defined in claim 1 wherein said mass constitutes up to 15% by weight of the bullet, said body constituting the remainder thereof.

* * * * *